US008698787B2

(12) United States Patent
Im et al.

(10) Patent No.: US 8,698,787 B2
(45) Date of Patent: Apr. 15, 2014

(54) METHOD FOR GENERATING A GAMMA VOLTAGE, DRIVING CIRCUIT THEREFOR, AND DISPLAY DEVICE

(75) Inventors: Chang-Jin Im, Seoul (KR); Hisashi Kimura, Suwon-si (KR); Sang-Jae Yeo, Hwaseong-si (KR); Moon-Chul Park, Seoul (KR)

(73) Assignee: Samsung Display Co., Ltd. (KR)

( * ) Notice: Subject to any disclaimer, the term of this patent is extended or adjusted under 35 U.S.C. 154(b) by 1375 days.

(21) Appl. No.: 12/044,796

(22) Filed: Mar. 7, 2008

(65) Prior Publication Data

US 2008/0278470 A1 Nov. 13, 2008

(30) Foreign Application Priority Data

May 11, 2007 (KR) ..... 10-2007-0046205

(51) Int. Cl.
*G09G 5/00* (2006.01)
*G09G 3/36* (2006.01)

(52) U.S. Cl.
USPC ..... 345/209; 345/87; 345/211; 345/94; 345/96

(58) Field of Classification Search
None
See application file for complete search history.

(56) References Cited

U.S. PATENT DOCUMENTS

| | | | | |
|---|---|---|---|---|
| 6,323,699 | B1 * | 11/2001 | Quiet | 327/108 |
| 7,834,844 | B2 * | 11/2010 | Kim et al. | 345/107 |
| 8,044,917 | B2 * | 10/2011 | Oh et al. | 345/100 |
| 2004/0169629 | A1 * | 9/2004 | Lee et al. | 345/95 |

FOREIGN PATENT DOCUMENTS

| | | |
|---|---|---|
| JP | 2003-114659 | 4/2003 |
| JP | 2004-205896 | 7/2004 |
| KR | 100206581 | 4/1999 |
| KR | 10-2000-0035466 A | 6/2000 |
| KR | 10-0621967 | 9/2006 |

* cited by examiner

*Primary Examiner* — Kenneth Bukowski
(74) *Attorney, Agent, or Firm* — Innovation Counsel LLP

(57) ABSTRACT

A method for generating a gamma voltage comprising, a first low voltage and a first high voltage having a first voltage range between the first low voltage and the first high voltage are divided into a plurality of gamma voltages of a first polarity during a first interval. A second low voltage and a second high voltage having a second voltage range between the second low voltage and the second high voltage are divided into a plurality of gamma voltages of a second polarity during a second interval.

20 Claims, 7 Drawing Sheets

METHOD FOR GENERATING A GAMMA VOLTAGE, DRIVING CIRCUIT THEREFOR, AND DISPLAY DEVICE

CROSS-REFERENCE TO RELATED APPLICATIONS

This application claims priority under 35 U.S.C. §119 to Korean Patent Application No. 2007-46205, filed on May 11, 2007 in the Korean Intellectual Property Office (KIPO), the contents of which are herein incorporated by reference in their entirety.

BACKGROUND OF THE INVENTION

1. Field of the Invention

The present invention relates to a method for generating a gamma voltage, a driving circuit for performing the method and a display device having the driving circuit. More particularly, the present invention relates a method for generating a gamma voltage, a driving circuit for performing the method capable of decreasing manufacturing costs thereof, and a display device having the driving circuit.

2. Description of the Related Art

Generally, a liquid crystal display (LCD) panel includes a gate line, a source line, a switching element, and a pixel electrode. The gate line and the source line are formed from different metal layers. The switching element is electrically connected to the gate line and the source line. The pixel electrode is formed from a transparent conductive material to be electrically connected to the switching element. The LCD panel includes a common electrode facing the pixel electrode. The pixel electrode, the common electrode and a liquid crystal layer interposed between the pixel electrode and the common electrode define a liquid crystal capacitor. A storage common electrode formed from the gate metal layer and the pixel electrode define a storage capacitor.

The LCD panel includes a liquid crystal capacitor, a storage capacitor and a parasitic capacitor between a gate electrode and a source electrode of the switching element. The liquid crystal capacitor, the storage capacitor and the parasitic capacitors may define a kickback voltage 'Vck', which is defined by the following Equation 1.

$$Vck = \frac{Cgs}{Clc + Cst + Cgs}(Von - Voff) \quad \text{Equation 1}$$

wherein 'Vck' represents a kickback voltage, 'Clc' represents the liquid crystal capacitance of the liquid crystal capacitor, 'Cst' represents the storage capacitance of the storage capacitor, 'Cgs' represents the parasitic capacitance between a gate electrode and a source electrode, 'Von' represents a gate-on voltage, and 'Voff' represents a gate-off voltage. The liquid crystal capacitance Clc is defined as $\in A/d$, wherein '$\in$' represents the dielectric constant of the liquid crystal, 'A' represents the size of a pixel electrode, and 'd' represents the cell gap of the liquid crystal layer.

Referring to Equation 1, the liquid crystal capacitance Clc has a different value according to the liquid crystal phase, so that the kickback voltage Vck has a different value for every gradation of liquid crystal phase. For example, when the liquid crystal molecules are in a twisted nematic (TN) mode and a normally white mode, the kickback voltages of each of 64 gradations are defined by the following Equation 2.

$$Vck(0Gray) < Vck(1Gray) <, \ldots, < Vck(32Gray) <, \ldots, < Vck(62Gray) < Vck(63Gray) \quad \text{Equation 2}$$

As shown in Equation 2, due to the difference of kickback voltages for each gradation, when a gamma reference voltage is set by a unique kickback voltage, flickering, afterimages, etc., may be generated.

SUMMARY OF THE INVENTION

The present invention provides a driving circuit for a display device as well as a method for generating a gamma voltage capable of achieving a simple circuit design.

According to an aspect of the present invention, a method of generating a gamma voltage comprises, generating a first voltage range lying between a first low voltage and a first high voltage; dividing the first voltage range into a plurality of gamma voltages of a first polarity during a first interval; generating a second voltage range different from the first voltage range lying between a second low voltage and a second high voltage; and dividing the second voltage range into a plurality of gamma voltages of a second polarity during a second interval.

In another example driving circuit according to the present invention, the driving circuit includes a voltage generating part and a gamma voltage generating part. The voltage generating part generates a first low voltage and a first high voltage having a first voltage range, which is a voltage range between the first low voltage and the first high voltage, and generates a second low voltage and a second high voltage having a second voltage range, which is a voltage range between the second low voltage and the second high voltage. The gamma voltage generating part includes a plurality of resistors serially coupled to each other, divides the first low voltage and the first high voltage to generate a plurality of gamma voltages of a first polarity, and divides the second low voltage and the second high voltage to generate a plurality of gamma voltages of a second polarity.

In another example display device according to the present invention, the display device includes a display panel, a voltage generating part, a gamma voltage generating part and a source driving part. The display panel includes pixel parts electrically connected to a source line and a gate line crossing the source line. The voltage generating part generates a first low voltage and a first high voltage having a first voltage range, which is a voltage range between the first low voltage and the first high voltage, and generates a second low voltage and a second high voltage having a second voltage range, which is a voltage range between the second low voltage and the second high voltage. The gamma voltage generating part includes a plurality of resistors serially coupled to each other, divides the first low voltage and the first high voltage to generate a plurality of gamma voltages of a first polarity, and divides the second low voltage and the second high voltage to generate a plurality of gamma voltages of a second polarity. The source driving part generates a plurality of gradation voltages of the first and second polarities by using the gamma voltages of the first and second polarities to output the source line.

According to the present invention, display quality may be enhanced. Furthermore, a gamma voltage generating circuit may be simplified, so that manufacturing costs of the gamma voltage generating circuit and the display device may be decreased.

BRIEF DESCRIPTION OF THE DRAWINGS

The above and other advantages of the present invention will become readily apparent by reference to the following detailed description when considered in conjunction with the accompanying drawings, wherein.

DESCRIPTION OF THE EMBODIMENTS

Hereinafter, the present invention will be described in detail with reference to the accompanying drawings.

Figure 1:
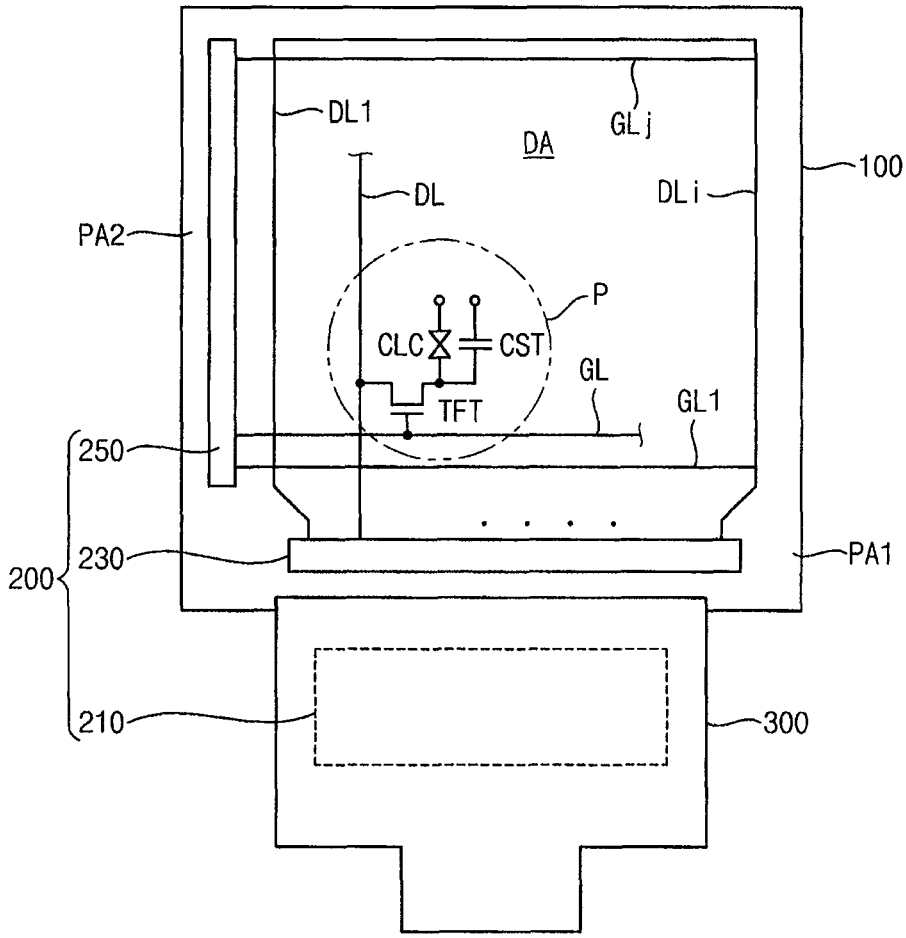
FIG. 1 is a schematic plan view illustrating a display device according to an exemplary embodiment of the present invention.
Figure 2:
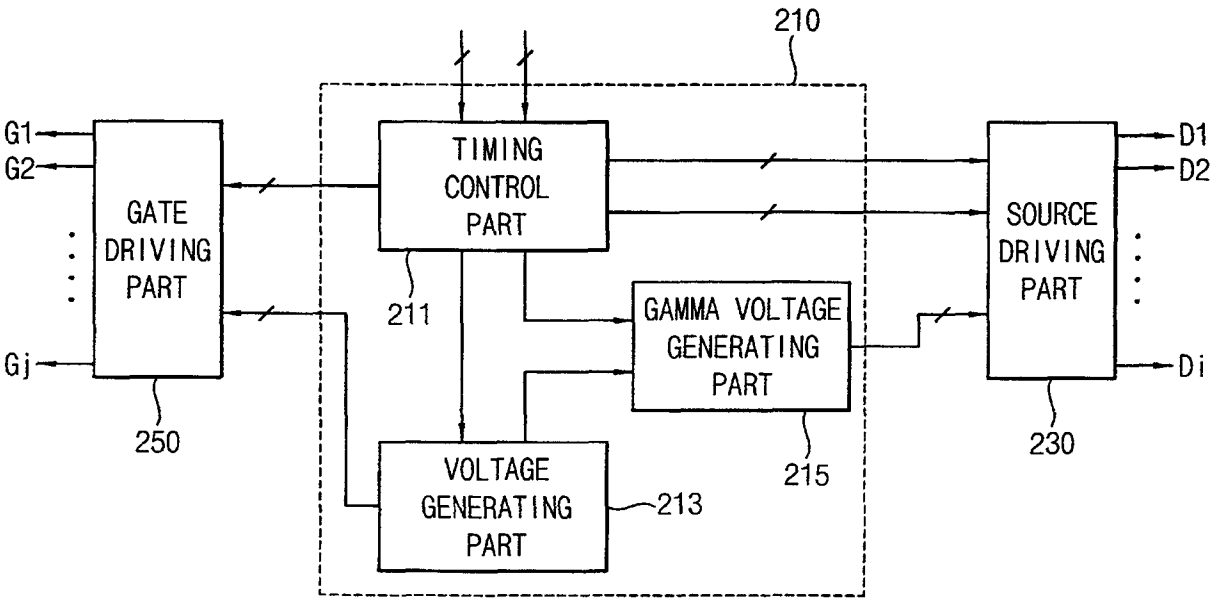
FIG. 2 is a block diagram illustrating the driving circuit of FIG. 1.

FIG. 1 is a schematic plan view illustrating a display device according to an exemplary embodiment of the present invention. FIG. 2 is a block diagram illustrating the driving circuit of FIG. 1.

Referring to FIGS. 1 and 2, a display device includes a display panel 100 and a driving circuit 200 that drives the display panel 100.

The display panel 100 includes a display area DA displaying an image, and first and second peripheral areas PA1 and PA2 surrounding the display area DA. A plurality of pixel parts electrically connected to a plurality of source lines DL1 to DLi and a plurality of gate lines GL1 to GLj is formed in the display area DA. Here, 'i' and 'j' are natural numbers. Each of the pixel parts includes a switching element TFT, a liquid crystal capacitor CLC and a storage capacitor CST. In the present exemplary embodiment, the display panel 100 is in a twisted nematic (TN) mode and a normally white mode.

The driving circuit 200 includes a main driving part 210, a source driving part 230 and a gate driving part 250. The main driving part 210 is disposed on a flexible printed circuit board (FPCB) 300 electrically connected to the display panel 100. The source driving part 230 is disposed in the first peripheral area PA1 adjacent to end portions of the source lines DL1 to DLi, and the gate driving part 250 is disposed in the second peripheral area PA2 adjacent to end portions of the gate lines GL1 to GLj.

The main driving part 210 includes a timing control part 211, a voltage generating part 213 and a gamma voltage generating part 215. The timing control part 211 provides the source driving part 230 with a data signal received from an external device. The timing control part 211 controls the main driving part 210, the source driving part 230 and the gate driving part 250, based on a control signal that is received from an external device.

The voltage generating part 213 generates a plurality of driving voltages, and outputs the driving voltages in response to the control of the timing control part 211. For example, the driving voltages include a gate-on voltage Von, a gate-off voltage Voff, a first common voltage VCOM1, a second common voltage VCOM2, a first low voltage Vb1, a first high voltage Vw1, a second low voltage Vb2, and a second high voltage Vw2.

The voltage generating part 213 provides the gate driving part 250 with the gate-on and gate-off voltages Von and Voff, and provides the liquid crystal capacitor CLC of the panel 100 with the first and second common voltages VCOM1 and VCOM2. The first common voltage VCOM1 has an opposite phase to the second common voltage VCOM2 with respect to a reference voltage Vr.

The voltage generating part 213 provides the first common voltage VCOM1 to the panel 100 during an N-th horizontal interval and provides the second common voltage VCOM2 to the panel 100 during an (N+1)-th horizontal interval, based on the control of the timing control part 211. Here, 'N' is a natural number. For example, the second common voltage VCOM2 has a first polarity with respect to the reference voltage Vr, and the first common voltage VCOM1 has a second polarity with respect to the reference voltage Vr. Hereafter, the first polarity will correspond to a negative polarity, and the second polarity will correspond to a positive polarity.

The voltage generating part 213 provides the first and second low voltages Vb1 and Vb2 and the first and second high voltages Vw1 and Vw2 to the gamma voltage generating part 215, based on a line inversion signal POL provided from the timing control part 211. For example, the timing control part 211 provides the line inversion signal of '0' to the voltage generating part 213 during the N-th horizontal interval and provides the line inversion signal of '1' to the voltage generating part 213 during the (N+1)-th horizontal interval.

The voltage generating part 213 provides the first low voltage Vb1 and the first high voltage Vw1 to the gamma voltage generating part 215 during the N-th horizontal interval and provides the second low voltage Vb2 and the second high voltage Vw2 to the gamma voltage generating part 215 during the (N+1)-th horizontal interval.

The first low voltage Vb1 and the first high voltage Vw1 have a first voltage range, and are smaller than the first common voltage VCOM1. The second low voltage Vb2 and the second high voltage Vw2 have a second voltage range and are larger than the second common voltage VCOM2. The first and second voltage ranges are different from each other.

The gamma voltage generating part 215 generates a plurality of negative gamma voltages by using the first low voltage Vb1 and the first high voltage Vw1 during the N-th horizontal interval and generates a plurality of positive gamma voltages by using the second low voltage Vb2 and second high voltage Vw2 during the (N+1)-th horizontal interval.

The source driving part 230 converts the data signals provided from the timing control part 211 into gradation voltages D1 to Di by using the gamma voltages to output a plurality of source lines DL1 to DLi, based on the control of the timing control part 211. For example, the source driving part 230 outputs negative gradation voltages to the source lines during the N-th horizontal interval when the voltage generating part 213 provides the first common voltage VCOM1 to the panel 100. The source driving part 230 outputs positive gradation voltages to the source lines during the (N+1)-th horizontal interval when the voltage generating part 213 provides the second common voltage VCOM2 to the display panel 100. Therefore, the display panel 100 is operated by a line inversion mode.

The gate driving part 250 generates gate signals G1 to Gj by using the gate-on/off voltages Von and Voff, based on the control of the timing control part 211, and outputs the gate signals G1 to Gj to the gate lines GL1 to GLj.

Hereinafter, a method of generating the negative and positive gamma voltages having the asymmetric structure using the first and second voltage ranges that are different from each other will be described in detail with reference to the following FIG. 3.

Figure 3:
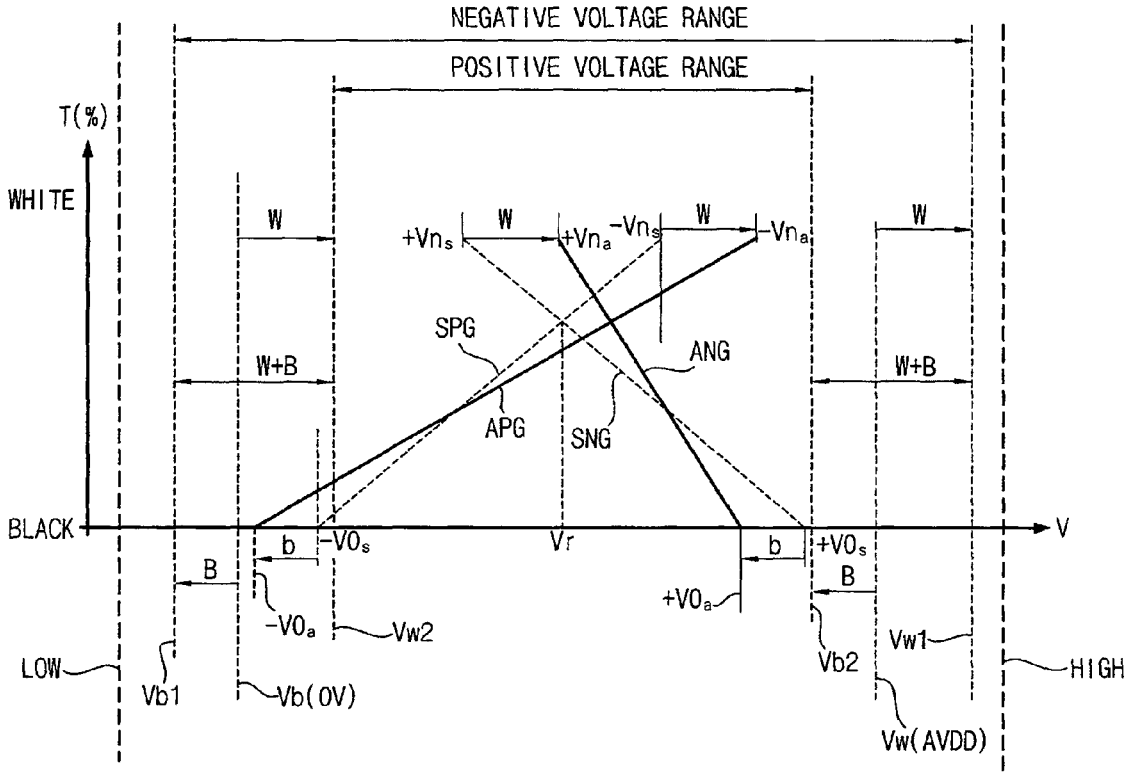
FIG. 3 is a graph showing a symmetric voltage-transmittance (V-T) curve and an asymmetric V-T curve.

FIG. 3 is a graph showing a symmetric voltage-transmittance (V-T) curve and an asymmetric V-T curve.

Referring to FIG. 3, the symmetric V-T curve is obtained when a kickback voltage corresponding to a halftone, for example, a kickback voltage Vck(32) corresponding to a $32^{nd}$ gradation among 64 gradations is adopted to all gradations.

The symmetric V-T curve includes a symmetric negative V-T curve SNG and a symmetric positive V-T curve SPG that are symmetric with each other with respect to a reference voltage Vr.

The symmetric negative V-T curve SNG shows a transmittance with respect to the negative gamma voltages −V0s to −Vns, and the symmetric positive V-T curve SPG shows a transmittance with respect to the positive gamma voltages +V0s to +Vns.

The negative and positive gamma voltages −V0s to −Vns and +V0s to +Vns are generated by using a first power voltage Vb and a second power voltage Vw having an opposite phase to the first power voltage Vb with respect to the reference voltage Vr. For example, the first power voltage Vb is '0 V', the second power voltage Vw is 'AVDD', and the reference voltage Vr is an average voltage $$\frac{AVDD}{2}$$

of the first and second voltages Vb and Vw.

A common voltage corresponding to the negative gamma voltage is a high signal HIGH and a common voltage corresponding to the positive gamma voltage is a low signal LOW. The high signal HIGH is generated by adding a constant voltage 'a' to the second power voltage Vw. The low signal LOW is generated by subtracting the constant voltage 'a' from the first power voltage Vb.

The asymmetric V-T curve is a V-T curve, in which a kickback voltage Vck(white) corresponds to a white gradation and a kickback voltage Vck(black) corresponding to a black gradation are adopted in the symmetric V-T curve. The asymmetric V-T curve includes an asymmetric negative V-T curve ANG and an asymmetric positive V-T curve APG.

A first adjustment value 'b' and a second adjustment value 'w' are calculated using the kickback voltage Vck(white) corresponding to a white gradation and the kickback voltage Vck(black) corresponding to a black gradation. A first shift value 'B' and a second shift value 'W' are calculated using the first and second adjustment values 'b' and 'w'. Here, the first and second movements 'B' and 'W' are proportional to the first and second adjustment values 'b' and 'w'.

The first and second shift values 'B' and 'W', and the first and second adjustment values 'b' and 'w' are defined by the following Equation 3.

$$w = Vck(\text{white}) - Vck(\text{middle})$$

$$b = Vck(\text{middle}) - Vck(\text{black})$$

$$w \propto W, b \propto B \qquad \text{Equation 3}$$

The asymmetric negative V-T curve ANG is a line segment that connects a transmittance corresponding to a low gradation gamma voltage +V0a with a transmittance corresponding to a high gradation gamma voltage +Vns. The transmittance corresponding to a low gradation gamma voltage +V0a is obtained by shifting a low gradation gamma voltage −V0s of the symmetric negative V-T curve SNG by the first adjustment value 'b'. The transmittance corresponding to high gradation gamma voltage +Vns is obtained by shifting the high gradation gamma voltage +Vns of the symmetric negative V-T curve SNG by the second adjustment value 'w'.

The asymmetric negative V-T curve ANG shows a transmittance with respect to the negative gamma voltages −V0a to −Vna. The negative gamma voltages −V0a to −Vna are generated by using the first low voltage Vb1 and the first high voltage Vw1 having the first voltage range.

In this case, the first low voltage Vb1 is a voltage '0-B' that is moved toward the left by as much as the first shift value 'B' from the first power voltage 'Vb=0 V'. The first high voltage Vw1 is a voltage 'AVDD+B' that is moved toward the right by as much as the second shift value 'W' from the second power voltage 'Vw=AVDD'.

The asymmetric positive V-T curve APG is a line segment that connects a transmittance corresponding to a low gradation gamma voltage −V0a with a transmittance corresponding to a transmittance corresponding to a high gradation gamma voltage −Vna. The transmittance corresponding to the low gradation −V0a is obtained by shifting the transmittance corresponding to a low gradation gamma voltage −Vs of the symmetric positive V-T curve SPG by the first adjustment value 'b'. The transmittance corresponding to the high gradation −Vna is obtained by shifting the transmittance corresponding to a high gradation gamma voltage −Vns of the symmetric positive V-T curve SPG by the second adjustment value 'w'.

The asymmetric positive V-T curve APG shows a transmittance with respect to the positive gamma voltages +V0a to +Vna. The positive gamma voltages +V0a to +Vna are generated by using the second low voltage Vb2 and the second high voltage Vw2 having the second voltage range.

In this case, the second low voltage Vb2 is a voltage 'AVDD−B' that is obtained by leftward shifting the second power voltage 'Vw=AVDD' by the first shift value 'B'. The second high voltage Vw2 is a voltage '0+W' that is obtained by rightward shifting the first power voltage 'Vb=0 V' by the second shift value 'W'.

The asymmetric gamma V-T curves ANG and APG are summarized in the following Table 1.

TABLE 1

| Polarity | Vb | Vw | Range of Gamma Voltage | VCOM |
|---|---|---|---|---|
| Negative | 0 − B | AVDD + W | (0 − B) to (AVDD + W) | High |
| Positive | AVDD − B | 0 + W | (AVDD − B) to (W) | Low |

Referring to Table 1, the asymmetric negative gamma voltages are generated to be in the first voltage range of '0-B' to 'AVDD+W', and the asymmetric positive gamma voltages are generated to be in the second voltage range of 'AVDD−B' to 'W'.

Figure 4:
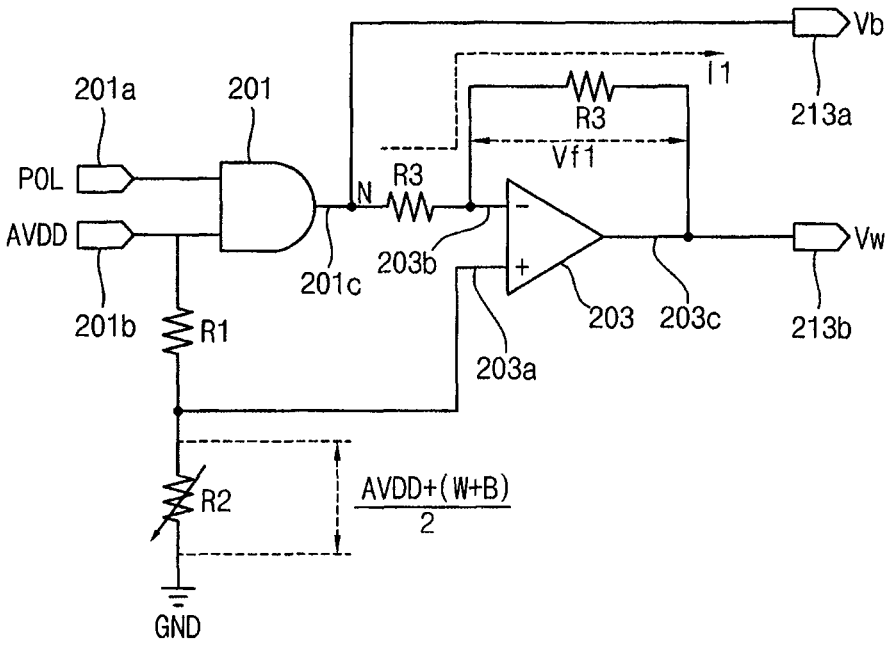
FIG. 4 is a partial circuit diagram illustrating a first section of the voltage generating part of FIG. 2, which generates a low voltage and a high voltage.

FIG. 4 is a partial circuit diagram illustrating a first section of the voltage generating part of FIG. 2, which generates a low voltage and a high voltage.

Referring to FIGS. 2 and 4, the voltage generating part 213 includes an AND gate 201 and a first operational amplifier (op-amp) 203.

The AND gate 201 includes a first input terminal 201*a*, a second input terminal 201*b* and an output terminal 201*c*. The first input terminal 201*a* receives a line inversion signal POL provided from the timing controller 211 and the second input terminal 201*b* receives a power voltage AVDD. The first input terminal 201*a* receives '0' or '1' and the second input terminal 201*b* receives the power voltage AVDD of a DC signal, that is, '1'.

Therefore, the AND gate 201 outputs a first low voltage Vb1 of '0' or a second low voltage Vb2 of '1' through the output terminal 201*c* in response to the line inversion signal POL '0' or '1'. Hereinafter, the first low voltage will be described as '0' and the second low voltage will be described as '1'.

The output terminal 201*c* is connected to a first output part 213*a* of the voltage generating part 213. The first low voltage Vb1 or the second low voltage Vb2 is outputted through the first output part 213*a*.

A first resistor R1 and a second resistor R2 are serially connected to each other between the second input terminal 201*b* and a ground terminal GND. The ground terminal has a voltage of 0 V.

A voltage of the second resistor R2 is provided to a reference terminal 203*a* of the first op-amp 203 to be a first reference signal of the first op-amp 203. A level of the first reference signal is defined by the second resistor R2. The level of the first reference signal is defined to be larger than an average voltage $$\frac{AVDD}{2}$$

of the first and second low voltages Vb1 and Vb2.

The level of the first reference signal is $$\frac{AVDD}{2}+\frac{(W+B)}{2}.$$

Here, 'W' and 'B' are the first shift value B and the second shift value W with the respect to the kickback voltage of the white gradation and the kickback voltage of the black gradation, as shown in FIG. 3.

The second resistor R2 may be a fixed resistor or a variable resistor. The level of the first reference signal may be adjusted by using the variable resistor in a process of flicker tuning.

The op-amp 203 includes the reference terminal 203*a* receiving the reference signal, an input terminal 203*b* receiving an output signal of the AND gate 201, and an output terminal 203*c* outputting an output signal of the op-amp 203. The output terminal 203*c* of the op-amp 203 is connected to a second output part 213*b* of the voltage generating part 213 to output a first high voltage Vw1 or a second high voltage Vw2.

A third resistor R3 connects the output terminal 201*c* of the AND gate 201 to the input terminal 203*b* of the first op-amp 203. Another third resistor R3 connects the input terminal 203*b* of the first op-amp 203 to the output terminal 203*c* of the first op-amp 203. The first op-amp 203 amplifies the first low voltage Vb1 or the second low voltage Vb2 outputted from the AND gate 201 to output the first high voltage Vw1 or the second high voltage Vw2.

Hereinafter, a process, in which the first and second low voltages Vb1 and Vb2, and the first and second high voltages Vw1 and Vw2 are generated by the voltage generating part 213, will be described.

A negative mode, in which the voltage generating part 213 receives the line inversion signal POL of '0', will be described.

The AND gate 201 outputs '0 V' in response to the line inversion signal POL of '0'. Thus, a voltage of a node N becomes '0 V' and the first output part 213*a* of the voltage generating part 213, which is connected to the node N, outputs '0 V' that is the first low voltage Vb1.

The reference terminal 203*a* of the first op-amp 203 receives the first reference signal $$\frac{AVDD}{2}+\frac{(W+B)}{2}$$

defined by the second resistor R2. The input terminal 203*b* of the first op-amp 203 receives an input voltage $$\frac{AVDD}{2}+\frac{(W+B)}{2}$$

equal to the first reference signal in accordance with characteristics of the first op-amp 203.

The voltage of the node N is '0 V' and the input voltage of the input terminal 203*b* is $$\frac{AVDD}{2}+\frac{(W+B)}{2},$$

so that a first current I1 between the node N and the second output part 213*b* is defined by the following Equation 4.

$$I1=\frac{V(N)-\frac{AVDD+(W+B)}{2}}{R3}=\frac{0-\frac{AVDD+(W+B)}{2}}{R3}=\frac{\frac{AVDD+(W+B)}{2}}{R3} \quad \text{Equation 4}$$

(Here, $V(N)=0$)

According to the first current I1, the first high voltage Vw1 outputted from the second output part 213*b* is defined by a difference between the input voltage of the input terminal 203*b* and a voltage of the third resistor R3, as in the following Equation 5.

$$\begin{aligned} Vw1 &= \frac{AVDD+(W+B)}{2}-Vf1 \\ &= \frac{AVDD+(W+B)}{2}-R3\cdot I1 \\ &= \frac{AVDD+(W+B)}{2}+R3\cdot\frac{\frac{AVDD+(W+B)}{2}}{R3} \\ &= AVDD+(W+B) \end{aligned} \quad \text{Equation 5}$$

For a negative mode, the first output part 213*a* of the voltage generating part 213 outputs the first low voltage Vb1 of '0 V', and the second output part 213*b* of the voltage generating part 213 outputs the first high voltage Vw1 of 'AVDD+(W+B)'. That is, the first high voltage Vw1 is obtained by adding a voltage (W+B) to the second low voltage (Vb2=AVDD).

A positive mode, in which the voltage generating part 213 receives the line inversion signal POL of '1', will be described.

The AND gate 201 outputs 'AVDD' in response to the line inversion signal POL of '1'. Thus, a voltage of a node N is 'AVDD' and the first output part 213*a* of the voltage generating part 213 connected to the node N outputs 'AVDD' that is the second low voltage Vb2.

The reference terminal 203*a* of the first op-amp 203 receives the first reference signal $$\frac{AVDD}{2}+\frac{(W+B)}{2}$$

defined by the second resistor R2. The input terminal 203*b* of the first op-amp 203 receives an input voltage $$\frac{AVDD}{2}+\frac{(W+B)}{2}$$

equal to the first reference signal in accordance with characteristics of the first op-amp 203.

The voltage of the node N is 'AVDD' and the input voltage of the input terminal 203*b* is $$\text{'}\frac{AVDD}{2}+\frac{(W+B)}{2}\text{'},$$

so that a first current I1 between the node N and the second output part 213*b* is defined by the following Equation 6.

$$I1=\frac{V(N)-\frac{AVDD+(W+B)}{2}}{R3}=\frac{AVDD-\frac{AVDD+(W+B)}{2}}{R3} \quad \text{Equation 6}$$

(Here, $V(N)=AVDD$)

According to the first current I1, the second high voltage Vw2 output from the second output part 213*b* is defined by the difference between the input voltage of the input terminal 203*b* and the voltage of the third resistor R3, as in the following Equation 7.

$$\begin{aligned} Vw2 &= \frac{AVDD+(W+B)}{2}-Vf1 \\ &= \frac{AVDD+(W+B)}{2}-R3\cdot I1 \\ &= \frac{AVDD+(W+B)}{2}-R3\cdot\frac{AVDD-\frac{AVDD+(W+B)}{2}}{R3} \end{aligned} \quad \text{Equation 7}$$

-continued $$\begin{aligned} &= \frac{AVDD+(W+B)}{2}-AVDD+\frac{AVDD+(W+B)}{2} \\ &= W+B \end{aligned}$$

For the positive mode, the first output part 213*a* of the voltage generating part 213 outputs the second low voltage Vb2, 'AVDD', and the second output part 213*b* of the voltage generating part 213 outputs the second high voltage Vw2, 'W+B'. That is, the second high voltage Vw2 is a voltage added the first low voltage (Vb2=0 V) to (W+B).

Figure 5:
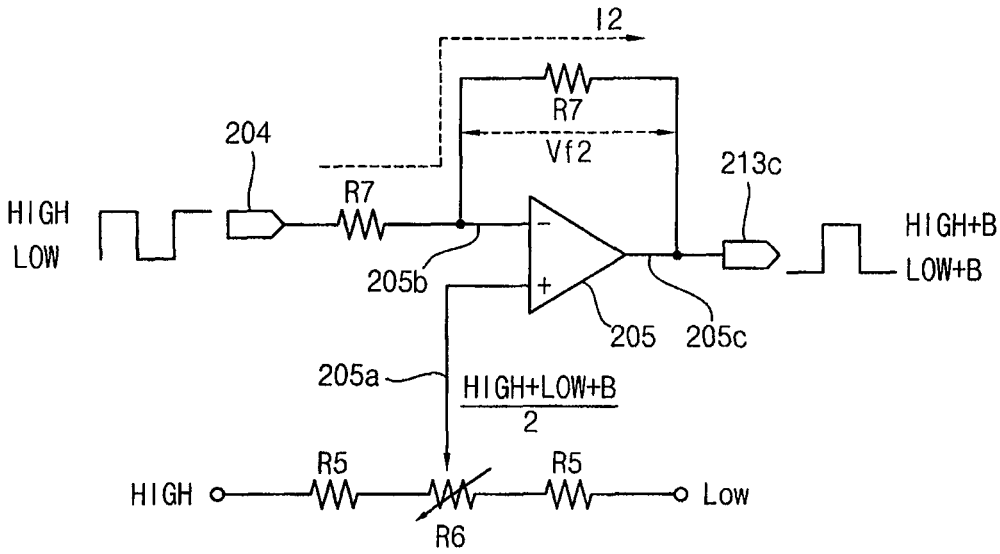
FIG. 5 is a partial circuit diagram illustrating a second section of the voltage generating part of FIG. 2, which generates a common voltage.

FIG. 5 is a partial circuit diagram illustrating a second section of the voltage generating part of FIG. 2, which generates a common voltage.

Referring to FIGS. 2 and 5, the voltage generating part 213 includes an input part 204 that receives a high signal HIGH and a low signal LOW having an opposite phase to the high signal HIGH with respect to a reference voltage Vr, and a second op-amp 205 amplifying and outputting the high and low signals HIGH and LOW. The high signal HIGH is obtained by adding a constant voltage 'a' to the second low voltage Vb2, and the low signal LOW is obtained by subtracting the constant voltage 'a' from the first low voltage Vb1.

The second op-amp 205 includes a reference terminal 205*a*, an input terminal 205*b*, and an output terminal 205*c* connected to a third output part 213*c* of the voltage generating part 213. The reference terminal 205*a* receives a second reference signal $$\frac{\text{HIGH}+\text{LOW}+B}{2}.$$

A circuit generating the second reference signal includes a plurality of fifth resistors R5 generating an average voltage $$\frac{\text{HIGH}+\text{LOW}}{2}$$

of the high and low voltages HIGH and LOW received by two terminals of the circuit, and a sixth resistor R6 connects the fifth resistors R5 to R5 in order to adjust the average voltage $$\frac{\text{HIGH}+\text{LOW}}{2}$$

to be the second reference signal $$\frac{\text{HIGH}+\text{LOW}+B}{2}.$$

The sixth resistor R6 may be a fixed resistor or a variable resistor. A level of the first common voltage VCOM1 and a level of the second common voltage VCOM2 may be adjusted by using the variable resistor in a process of flicker tuning.

The input terminal 205*b* of the second op-amp 205 receives an input voltage equal to the second reference signal $$\frac{\text{HIGH}+\text{LOW}+B}{2}$$

in accordance with op-amp characteristics.

A seventh resistor R7 connects the input part 204 to the input terminal 205*b* of the second op-amp 205, and another seventh resistor R7 connects the input terminal 205*b* to the output terminal 205*c* of the second op-amp 205.

When the input part 204 receives the low signal LOW, a second current I2 flowing between the input part 204 and the third output part 213*c* is defined by the following Equation 8.

$$I2 = \frac{\text{LOW} - \frac{\text{HIGH} + \text{LOW} + B}{2}}{R7} \quad \text{Equation 8}$$

The first common voltage VCOM1 output from the third output part 213*c* is defined by a voltage difference between the input terminal 205*b* of the second op-amp 205 and a voltage Vf2 of the seventh resistor R7, as in the following Equation 9.

$$\begin{aligned} VCOM1 &= \frac{\text{HIGH} + \text{LOW} + B}{2} - Vf2 \\ &= \frac{\text{HIGH} + \text{LOW} + B}{2} - R7 \cdot Vf2 \\ &= \frac{\text{HIGH} + \text{LOW} + B}{2} - R7 \cdot \frac{\left(\text{LOW} - \frac{\text{HIGH} + \text{LOW} + B}{2}\right)}{R7} \\ &= \text{HIGH} + B \end{aligned} \quad \text{Equation 9}$$

When the input part 204 receives the high signal HIGH, a second current I2 between the input part 204 and the third output part 213*c* is defined by the following Equation 10.

$$I2 = \frac{\left(\text{HIGH} - \frac{\text{HIGH} + \text{LOW} + B}{2}\right)}{R7} \quad \text{Equation 10}$$

The second common voltage VCOM2 outputted from the third output part 213*c* is defined by a voltage difference between the input terminal 205*b* of the second op-amp 205 and a voltage Vf2 of the seventh resistor R7, as in the following Equation 11.

$$\begin{aligned} VCOM2 &= \frac{\text{HIGH} + \text{LOW} + B}{2} - Vf2 \\ &= \frac{\text{HIGH} + \text{LOW} + B}{2} - R7 \cdot I2 \\ &= \frac{\text{HIGH} + \text{LOW} + B}{2} - R7 \cdot \end{aligned} \quad \text{Equation 11}$$

-continued $$\frac{\left(\text{HIGH} - \frac{\text{HIGH} + \text{LOW} + B}{2}\right)}{R7} = \text{LOW} + B$$

Thus, the driving of the voltage generating part 213 is summarized in the following Table 2.

TABLE 2

| POL | Vb | Vw | Range of the voltage | VCOM | Polarity |
|---|---|---|---|---|---|
| 0 | 0 | AVDD + (W + B) | '0' to 'AVDD + (W + B)' | High + B | Negative |
| 1 | AVDD | (W + B) | 'AVDD' to '(W + B)' | Low + B | Positive |

Figure 6:
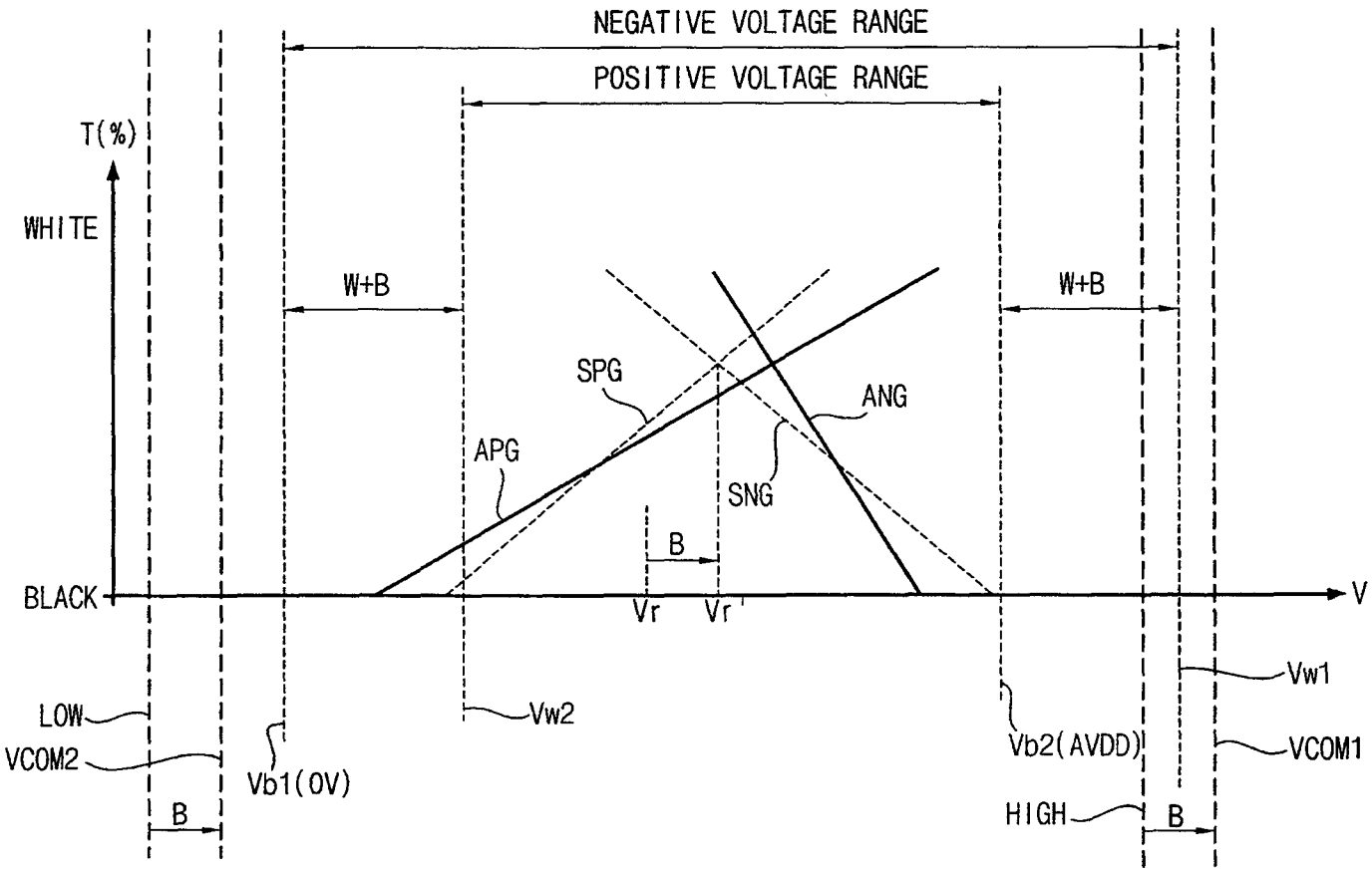
FIG. 6 is a graph showing an asymmetric V-T curve obtained from the voltage generating part of FIGS. 4 and 5.

FIG. 6 is a graph showing an asymmetric V-T curve obtained from the voltage generating part of FIGS. 4 and 5.

Referring to FIGS. 3 and 6, in the case of the negative mode, the voltage generating part 213 generates the first low voltage Vb1 of 0 V, the first high voltage Vw1 of 'AVDD+(W+B)' and the first common voltage VCOM1 of 'HIGH+B'. A range of the asymmetric negative gamma voltages is '0' to 'AVDD+(W+B).

The range of the asymmetric negative gamma voltages in a range of '0 to AVDD+(W+B)' is obtained by rightward shifting '0-B to AVDD+W' in FIG. 3 by the first shift value B. The first common voltage VCOM1 is obtained by rightward shifting the high signal HIGH shown in FIG. 3 by the first shift value B.

In the case of the positive mode, the voltage generating part 213 generates the second low voltage Vb2 of AVDD, the second high voltage Vw2 of '(W+B)' and the second common voltage VCOM2 of 'LOW+B'. A range of the asymmetric positive gamma voltages is 'AVDD' to '(W+B)'.

The range of the asymmetric positive gamma voltages in a range of 'AVDD to (W+B)' is obtained by rightward shifting the asymmetric positive gamma voltages in a range of 'AVDD-B' to 'W' in FIG. 3 by the first shift value B. The second common voltage VCOM2 is obtained by rightward shifting the low signal LOW shown in FIG. 3 by the first shift value B.

Therefore, the voltage generating part 213 sets the first and second voltages Vb1 and Vb2, and amplifies the first and second voltages Vb1 and Vb2 to the first and second high voltages Vw1 and Vw2 through the first op-amp 203. The voltage generating part 213 generates the first low voltage Vb1 and the first high voltage Vw1 in the negative mode, and generates the second low voltage Vb2 and the second high voltage Vw2 in the positive mode, respectively. The voltage generating part 213 generates the low and high voltages different from each other in the negative and positive modes, so that the voltage generating part 213 may be simplified.

Figure 7:
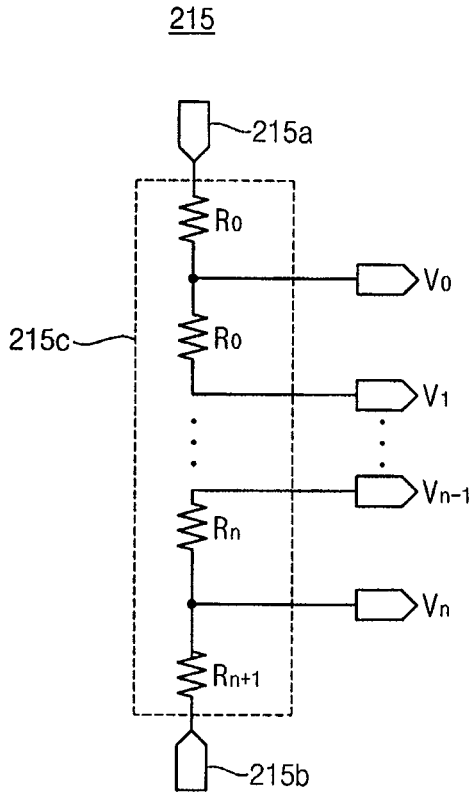
FIG. 7 is a circuit diagram illustrating the gamma voltage generating part of FIG. 2.
Figure 8:
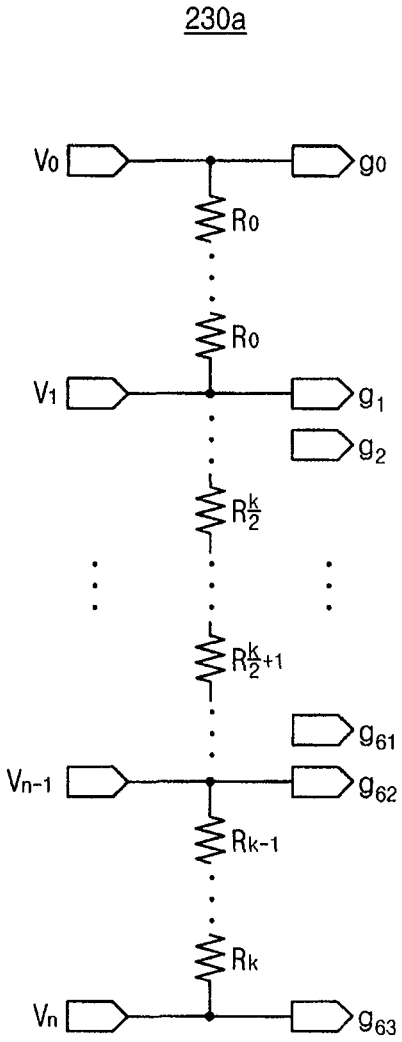
FIG. 8 is a partial circuit diagram illustrating the source driving part of FIG. 2.

FIG. 7 is a circuit diagram illustrating the gamma voltage generating part of FIG. 2. FIG. 8 is a partial circuit diagram illustrating the source driving part of FIG. 2.

Referring to FIG. 7, a gamma voltage generating part 215 includes a first power terminal 215*a*, a second power terminal 215*b* and a resistor string part 215*c*.

The first power terminal 215*a* receives the first and second low voltages Vb1 and Vb2. The first power terminal 215*a* receives the first low voltage Vb1 in the horizontal interval of N-th, and receives the second low voltage Vb2 in the horizontal interval of (N+1)-th.

The second power terminal 215*b* receives the first and second high voltages Vw1 and Vw2. The second power terminal 215*b* receives the first high voltage Vw1 in the horizontal interval of N-th, and receives the second high voltage Vw2 in the horizontal interval of (N+1)-th.

The resistor string part 215*c* includes a plurality of resistors R0 to Rn+1 that are serially coupled to each other. A plurality of output terminals is formed between the resistors R0 to Rn+1. The resistor string part 215*c* divides the low and high voltages that are applied to the first and second power terminals 215*a* and 215*b* into a plurality of gamma voltages.

For example, the resistor string part 215*c* divides the first low voltage Vb1 and the first high voltage Vw1 that are applied to the first and second power terminals 215*a* and 215*b* into a plurality of the negative gamma voltages, −V0, −V1, . . . , −Vn−1 and −Vn. The resistor string part 215*c* divides the second low voltage Vb2 and the second high voltage Vw2 that are applied to the first and second power terminals 215*a* and 215*b* into a plurality of the positive gamma voltages, +V0, +V1, . . . , +Vn−1 and +Vn.

The plurality of negative gamma voltages and the plurality of positive gamma voltages ±V0, ±V1, . . . , ±Vn−1 and ±Vn are provided with the source driving part 230. The source driving part 230 includes a gradation voltage generating part 230*a*.

Referring to FIG. 8, the gradation voltage generating part 230*a* includes a resistor string having a plurality of resistors R1 to Rk that are electrically connected in series. Each of the gamma voltages ±V0, ±V1, . . . , ±Vn−1 and ±Vn are applied to the resistors R1, . . . , Rk, respectively, so that a plurality of gradation voltages, for example, 64 gradation voltages ±g0, ±g1, . . . , ±g62 and ±g63 corresponding to the total gradation is generated.

For example, each of the negative gamma voltages −V0, −V1, . . . , −Vn−1 and −Vn are applied to the resistors R1, . . . , Rk, respectively, so that a plurality of negative gradation voltages, −g0, −g1, . . . , −g62 and −g63 in the horizontal interval of N-th is outputted. Each of the positive gamma voltages +V0, +V1, . . . , +Vn−1 and +Vn are applied to the resistors R1, . . . , Rk, respectively, so that a plurality of positive gradation voltages, +g0, +g1, . . . , +g62 and +g63 in the horizontal interval of (N+1)-th is outputted.

As described above, according to the present invention, first and second polarity gamma voltages may be alternately generated using a gamma voltage generating circuit having one resistor string. Two terminals of the resistor string receive a first low voltage and a first high voltage having a first voltage range in a first polarity mode and receive a second low voltage and a second high voltage having a second voltage range in a second polarity mode to generate the first and second polarity gamma voltages.

Therefore, a circuit for generating the gamma voltages may be simplified and manufacturing costs may be decreased. Furthermore, as an asymmetric V-T curve is adapted to the gamma voltage generating circuit, display quality problems, such as flickering, afterimages, etc. may be improved.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method for generating kickback-compensating gamma voltages when in respective positive and negative polarity modes of a Liquid Crystal Display (LCD) system that exhibits a variable kickback effect for each respective pixel transistor used to drive a respective liquid crystal pixel, where the kickback effect is dependent on the drive polarity mode then in effect and on a grayscale gradation to be presented by the respective liquid crystal pixel, the method comprising:

establishing a first low voltage (Vb1) and a first high voltage (Vw1) for use in generating respective, negative polarity gamma voltages when the negative polarity mode is true;

using the established first low voltage (Vb1) and first high voltage (Vw1) when the negative polarity mode is true to generate the respective negative polarity gamma voltages, wherein magnitudes of the generated negative polarity gamma voltages are at least partially determined according to the established first low and high voltages (Vb1, Vw1) to thereby compensate in the negative polarity mode for corresponding kickback effects;

establishing a second low voltage (Vb2) and a second high voltage (Vw2) for use in generating respective positive polarity gamma voltages when the positive polarity mode is true, where Vb2 is different from Vb1 and where Vw2 is different from Vw1; and using the established second low voltage (Vb2) and second high voltage (Vw2) when the positive polarity mode is true to generate the respective positive polarity gamma voltages, wherein magnitudes of the generated positive polarity gamma voltages are at least partially determined according to the established second low and high voltages (Vb2, Vw2) to thereby compensate in the positive polarity mode for corresponding kickback effects.

2. The method of claim 1, wherein a first of the positive and negative polarity modes occurs in a respective first gate line activating interval which is an N-th (N is a natural number) horizontal interval of the LCD system and the other of the positive and negative polarity modes occurs in a respective second interval which is an (N+1)-th horizontal interval.

3. A driving circuit for use in generating kickback-compensating gamma voltages for respective positive and negative polarity modes of a Liquid Crystal Display (LCD) system that exhibits a variable kickback effect for each respective pixel transistor used to drive a respective liquid crystal pixel, where the kickback effect is dependent on the drive polarity mode then in effect and on a grayscale gradation to be presented by the respective liquid crystal pixel, the driving circuit comprising:

a voltage generating part configured to output a first low voltage (Vb1) and a first high voltage (Vw1) for use in generating respective, negative polarity gamma voltages for said LCD system when the negative polarity mode is true in said LCD system and to output a second low voltage (Vb2) and a second high voltage (Vw2) for use in generating respective positive polarity gamma voltages for said LCD system when the positive polarity mode is true, where Vb2 is different from Vb1 and where Vw2 is different from Vw1; and a gamma voltages generating part, operatively coupled to the voltage generating part to receive therefrom either the first low and high voltages (Vb1, Vw1) or the second low and high voltages (Vb2, Vw2) as control signals, the gamma voltages generating part including a plurality of resistors serially coupled to each other, the gamma voltages generating part being configured to generate the respective, negative polarity gamma voltages in a range extending from the first low voltage to the first high voltage when the negative polarity mode is true, and configured to generate the respective positive polarity gamma voltages in a range extending from the second low voltage to the second high voltage when the positive polarity mode is true, wherein magnitudes of the generated gamma voltages are at least partially determined to compensate for said variable kickback effect of the LCD system.

4. The driving circuit of claim 3, wherein the voltage generating part is configured to generate a first common voltage and a second common voltage having an opposite phase to the first common voltage with respect to a reference voltage.

5. The driving circuit of claim 4, wherein the first common voltage is higher than the first low voltage and the first high voltage, and the second common voltage is lower than the second low voltage and the second high voltage.

6. The driving circuit of claim 5, wherein the voltage generating part includes:

an AND gate configured to output the first low voltage or the second low voltage in response to a line inversion signal; and an operational amplifier (op-amp) configured to amplify and output the first low voltage or the second low voltage to the first high voltage or the second high voltage according to a reference signal.

7. The driving circuit of claim 6, wherein the op-amp is connected to a variable resistor to adjust the reference signal.

8. The driving circuit of claim 6, wherein the reference signal is higher than an average voltage of the first and second low voltages.

9. The driving circuit of claim 8, wherein the reference signal is defined by the following Equation:

$$\frac{Vb1 + Vb2}{2} + \frac{(W + B)}{2}$$

$$w \propto W,\ b \propto B$$

$$w = Vck(\text{white}) - Vck(\text{middle})$$

$$b = Vck(\text{middle}) - Vck(\text{black})$$

wherein Vb1 is the first low voltage, Vb2 is the second low voltage, Vck(white) is a kickback voltage of a white gradation, Vck(black) is a kickback voltage of a black gradation, and Vck(middle) is a kickback voltage of a halftone that is between the white gradation and the black gradation.

10. The driving circuit of claim 9, wherein the first low voltage Vb1, the second low voltage Vb2, the first high voltage Vw1 and the second high voltage Vw2 are defined by the following Equation:

$$Vw1 = Vb2 + (W + B)$$

$$Vw2 = Vb1 + (W + B).$$

11. The driving circuit of claim 10, wherein the first common voltage VCOM1 and the second common voltage VCOM2 are defined by the following Equation:

$$VCOM1 = (Vb2 + a) + B$$

$$VCOM2 = (Vb1 - a) + B$$

wherein 'a' is a constant voltage.

12. A liquid crystal display device (LCD) that exhibits a variable kickback effect for each respective pixel transistor used therein to drive a respective liquid crystal pixel, where the kickback effect is dependent on the drive polarity mode then in effect and on a grayscale gradation to be presented by the respective liquid crystal pixel, the LCD comprising:

a display panel including pixel parts each electrically connected to a respective source line and to a respective gate line and each including at least one said respective pixel transistor;

a voltage generating part configured to output a first low voltage (Vb1) and a first high voltage (Vw1) for use in generating respective, negative polarity gamma voltages for said LCD system when the negative polarity mode is true in said LCD system and to output a second low voltage (Vb2) and a second high voltage (Vw2) for use in generating respective positive polarity gamma voltages for said LCD system when the positive polarity mode is true, where Vb2 is different from Vb1 and where Vw2 is different from Vw1; and a gamma voltages generating part, operatively coupled to the voltage generating part to receive therefrom either the first low and high voltages (Vb1, Vw1) or the second low and high voltages (Vb2, Vw2) as control signals, the gamma voltages generating part including a plurality of resistors serially coupled to each other, the gamma voltages generating part being configured to generate the respective, negative polarity gamma voltages in a range extending from the first low voltage to the first high voltage when the negative polarity mode is true, and configured to generate the respective positive polarity gamma voltages in a range extending from the second low voltage to the second high voltage when the positive polarity mode is true, wherein magnitudes of the generated gamma voltages are at least partially determined to compensate for said variable kickback effect of the LCD system; and a source driving part operatively coupled to the respective source lines and to the gamma voltages generating part, and configured to generate a plurality of respective source line driving voltages of the positive and negative polarities by using the gamma voltages generated by the gamma voltages generating part.

13. The display device of claim 12, wherein the voltage generating part configured to generate a first common voltage and a second common voltage having an opposite phase to the first common voltage with respect to a reference voltage.

14. The display device of claim 13, wherein the voltage generating part configured to output the first common voltage to the display panel during output of the gray voltage of the first polarity to the source line, and is configured to output the second common voltage to the panel during output of the gray voltage of the second polarity to the source line.

15. The display device of claim 14, wherein the first common voltage is higher than the first low voltage and the first high voltage, and the second common voltage is lower than the second low voltage and the second high voltage.

16. The display device of claim 14, wherein the voltage generating part including:

an AND gate configured to output the first low voltage or the second low voltage in response to a line inversion signal; and an op-amp configured to amplify and output the first low voltage or the second low voltage to the first high voltage or the second high voltage according to a reference signal.

17. The display device of claim 16, wherein the reference signal is higher than an average voltage of the first and second low voltages.

18. The driving circuit of claim 17, wherein the reference signal is defined by the following Equation:

$$\frac{Vb1 + Vb2}{2} + \frac{(W + B)}{2}$$

$$w \propto W,\ b \propto B$$

$$w = Vck(\text{white}) - Vck(\text{middle})$$

$$b = Vck(\text{middle}) - Vck(\text{black})$$

wherein Vb1 is the first low voltage, Vb2 is the second low voltage, Vck(white) is a kickback voltage of a white gradation, Vck(black) is a kickback voltage of a black gradation, and Vck(middle) is a kickback voltage of a halftone that is between the white gradation and the black gradation.

19. The driving circuit of claim 18, wherein the first low voltage Vb1, the second low voltage Vb2, the first high voltage Vw1 and the second high voltage Vw2 are defined by the following Equation:

$$Vw1 = Vb2 + (W + B)$$

$$Vw2 = Vb1 + (W + B).$$

20. The driving circuit of claim 19, wherein the first common voltage VCOM1 and the second common voltage are defined by the following Equation:

$$VCOM1 = (Vb2 + a) + B$$

$$VCOM2 = (Vb1 - a) + B$$

wherein 'a' is a constant voltage.

* * * * *